US006460283B1

(12) United States Patent
Ramos

(10) Patent No.: US 6,460,283 B1
(45) Date of Patent: Oct. 8, 2002

(54) TRIGGER LOCKING MECHANISM

(75) Inventor: Israel Ramos, Miami, FL (US)

(73) Assignee: Suregun Lock, Inc., Weston, FL (US)

( * ) Notice: Subject to any disclaimer, the term of this patent is extended or adjusted under 35 U.S.C. 154(b) by 0 days.

(21) Appl. No.: 09/680,914

(22) Filed: Oct. 6, 2000

(51) Int. Cl.[7] ..... F41A 17/54
(52) U.S. Cl. ..... 42/70.07; 42/70.01
(58) Field of Search ..... 42/70.07, 70.06, 42/70.11

(56) References Cited

U.S. PATENT DOCUMENTS 2,664,658 A * 1/1954 Bjorklund
2,742,726 A * 4/1956 Feller
3,422,560 A * 1/1969 Foote et al.
3,634,963 A * 1/1972 Hermann
3,774,333 A * 11/1973 Reynolds
4,995,180 A * 2/1991 Tucker et al.
5,241,769 A * 9/1993 Von Muller
5,331,759 A * 7/1994 Marceau et al.
5,437,119 A * 8/1995 Womack
5,669,252 A * 9/1997 Bentley
5,680,723 A * 10/1997 Ruiz
6,256,917 B1 * 7/2001 Findlay
6,276,086 B1 * 8/2001 Keaton

* cited by examiner

*Primary Examiner*—Michael J. Carone
*Assistant Examiner*—Troy Chambers

(57) ABSTRACT

A security device for weapons that makes them inoperable with a mechanism that can be readily installed. A plate assembly has a locking assembly mounted thereon with a retractable tongue. A spaced apart rigid assembly mounted on the plate assembly receives the distal end of the tongue. A weapon's trigger is lodged between the plate and the tongue and between the locking assembly and the rigid assembly. A user activates the locking assembly with a key to selectively make the weapon's trigger inoperable and inaccessible.

4 Claims, 1 Drawing Sheet

TRIGGER LOCKING MECHANISM

BACKGROUND OF THE INVENTION

1. Field of the Invention

The present invention relates to a trigger locking mechanism, and more particularly, to a mechanism that permits locking the trigger of a wide variety of pistols and hand guns.

2. Description of the Related Art

Many designs for weapon security devices have been designed in the past. None of them, however, include a locking mechanism that make the trigger completely inoperable and inaccessible as the present invention.

Applicant believes that the closest reference corresponds to U.S. Pat. No. 2,742,726 issued to R. S. Feller (1956) for Gun Trigger Lock. Feller's patent discloses a lock device for the trigger guard to cover the associated trigger and preclude firing of the gun while the lock device is in place. However, it differs from the present invention because it lacks a tongue member to fully immobilize the trigger.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a device that readily makes hand guns and pistols inoperable to unauthorized users.

It is another object of this invention to provide a device that can be readily installed in different hand guns and pistols.

It is still another object of the present invention to provide a device that can be used without damaging the protected weapon.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
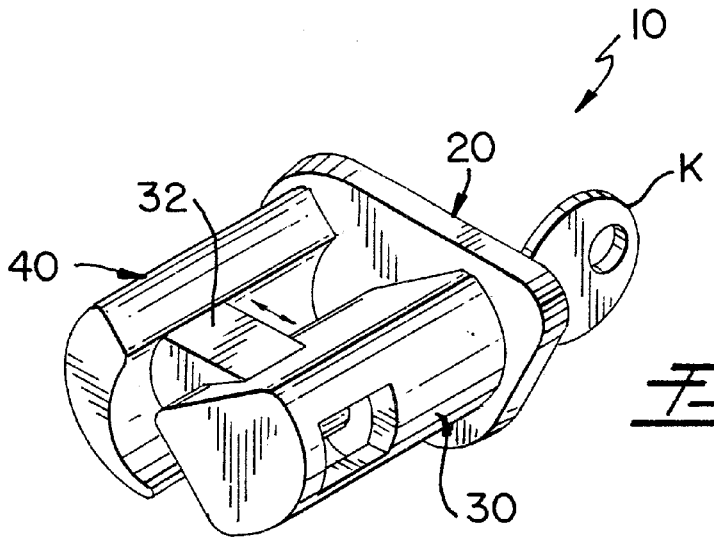
FIG. 1 represents an isometric view showing one end of an embodiment for the present invention.
Figure 2:
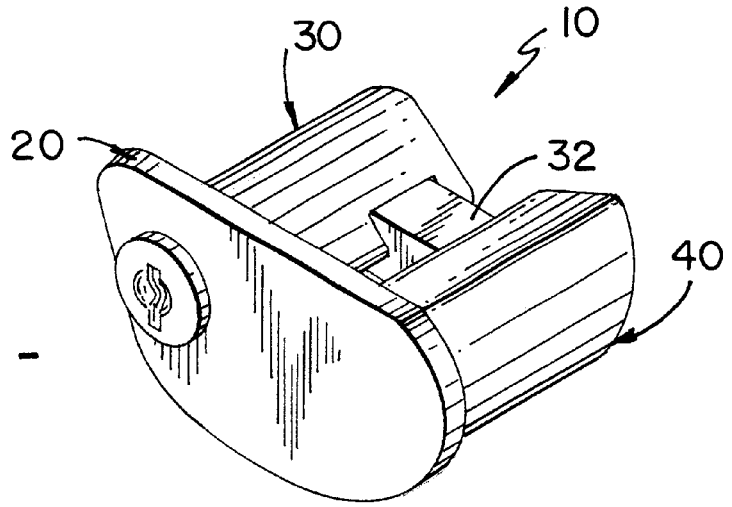
FIG. 2 shows an isometric view showing the other end of the embodiment shown in FIG. 1.

Referring now to the drawings, where the present invention is generally referred to with numeral 10, it can be observed that it basically includes plate assembly 20 with locking assembly 30 and opposite rigid assembly 40 mounted perpendicularly thereon and spaced apart from each other. A retractable tongue 32 protrudes out of assembly 30 and is partially housed inside rigid assembly 40 at its distal end. Tongue 32 travels back and forth along a plane that is parallel and spaced away from plate assembly 20.

Figure 3:
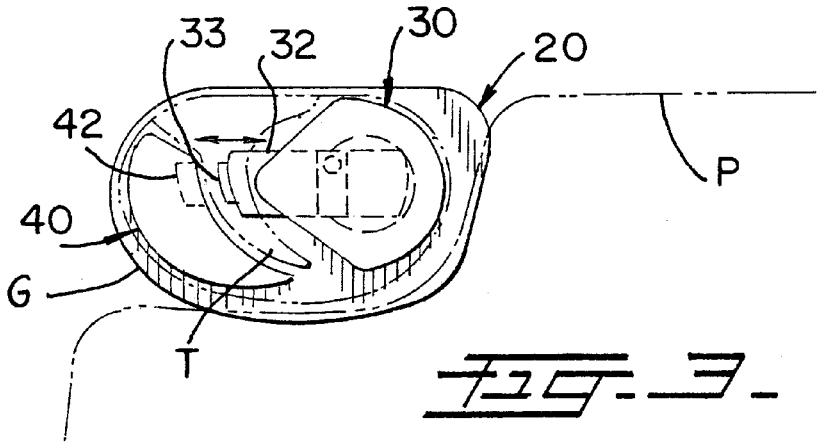
FIG. 3 illustrates a front elevational view of the present invention with a partial representation of a pistol P in phantom.

As seen in FIG. 3, a trigger T of pistol P is lodged between locking assembly 30 and rigid assembly 40 being positioned adjacent to plate assembly 20.

Assemblies 20; 30 and 40 are removably mounted within trigger guard G.

In the locked position, tongue 32 is positioned adjacent to trigger T in opposite to plate 20, thereby sandwiching trigger T inbetween. Bore 42 receives distal end 33 of tongue 32 enhancing the locked structural integrity of the device. A user moves tongue 32 through the actuation of locking assembly 30 which in term is activated with key K.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A security device for weapons having a trigger guard, comprising:

A) a base assembly having first and second sides;

B) a locking assembly mounted on said first side and further including means for actuating said locking assembly and further including a retractable tongue member that extends outside said locking assembly a predetermined distance when said device is in the locked position and said tongue member travels in a plane that is at a spaced apart and parallel relationship with respect to said base assembly;

C) a rigid assembly perpendicularly mounted to said first side at a parallel and cooperative spaced apart relationship with respect to said locking assembly to permit the lodging of a weapon's trigger inbetween and adapted to receive the distal end of said retractable tongue adjacent to said trigger thereby immobilizing the latter and said base assembly, locking assembly and rigid assembly being removably mounted within said trigger guard.

2. The security device set forth in claim 1 further including a key member to actuate said locking assembly.

3. The security device set forth in claim 2 wherein said locking assembly and said rigid assembly substantially conform to the shape of said trigger to ensure it's immobilization.

4. The security device set forth in claim 3 wherein said rigid assembly includes a bore for cooperatively receiving said distal end.

* * * * *